US009474433B2

(12) United States Patent
Unverdi et al.

(10) Patent No.: US 9,474,433 B2
(45) Date of Patent: Oct. 25, 2016

(54) DISHWASHER COMPRISING AN AUTOMATIC DOOR OPENING MECHANISM

(71) Applicant: Arcelik Anonim Sirketi, Istanbul (TR)

(72) Inventors: Uygar Unverdi, Istanbul (TR); Serkan Tarcin, Istanbul (TR); Tuna Balkan, Istanbul (TR); Erhan Ilhan Konukseven, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 32 days.

(21) Appl. No.: 14/370,046

(22) PCT Filed: Dec. 21, 2012

(86) PCT No.: PCT/EP2012/076684

§ 371 (c)(1),
(2) Date: Jun. 30, 2014

(87) PCT Pub. No.: WO2013/098245

PCT Pub. Date: Jul. 4, 2013

(65) Prior Publication Data

US 2014/0346938 A1 Nov. 27, 2014

(30) Foreign Application Priority Data

Dec. 30, 2011 (TR) ..... a 2011 13320

(51) Int. Cl.

| | |
|---|---|
| ***A47L 15/42*** | (2006.01) |
| ***A47L 15/48*** | (2006.01) |
| *A47L 15/00* | (2006.01) |

(52) U.S. Cl.

CPC ..... *A47L 15/4259* (2013.01); *A47L 15/488* (2013.01); *A47L 15/0034* (2013.01); *A47L 2401/20* (2013.01); *A47L 2501/22* (2013.01)

(58) Field of Classification Search

CPC ..... A47L 15/488; A47L 15/4259; A47L 15/4261; A47L 15/4257; E05Y 2900/304

USPC ..... 312/228, 311, 326, 327, 319.8; 292/DIG. 69; 134/57 DL, 58 DL, 201

See application file for complete search history.

(56) References Cited

U.S. PATENT DOCUMENTS

| | | | | |
|---|---|---|---|---|
| 4,951,693 A * | 8/1990 | Archambault | ..... | A47L 15/0034 134/57 DL |
| 8,454,102 B2 * | 6/2013 | Kim | ..... | E05F 15/619 312/319.5 |
| 2004/0163684 A1 * | 8/2004 | Hapke | ..... | A47L 15/4259 134/57 DL |

(Continued)

FOREIGN PATENT DOCUMENTS

| | | |
|---|---|---|
| EP | 0687439 A1 | 12/1995 |
| EP | 0711528 A1 | 5/1996 |

(Continued)

*Primary Examiner* — James O Hansen

(74) *Attorney, Agent, or Firm* — Kilpatrick Townsend & Stockton LLP

(57) ABSTRACT

The present invention relates to a dishwasher (1) wherein the door (3) is opened automatically by means of the door opening mechanism (13) at the end of the washing and drying processes and a fast drying is performed by discharging the vapor accumulated in the body (2) at the end of the washing and drying processes to the outside and wherein by means of the adjustment means (8), the door opening mechanism (13) applies pressure on the door (3) after being actuated and the opening/closing force of the bolt (5) of the locking mechanism (4) is decreased at the same time.

15 Claims, 1 Drawing Sheet

(56) References Cited

U.S. PATENT DOCUMENTS

Figure 1:
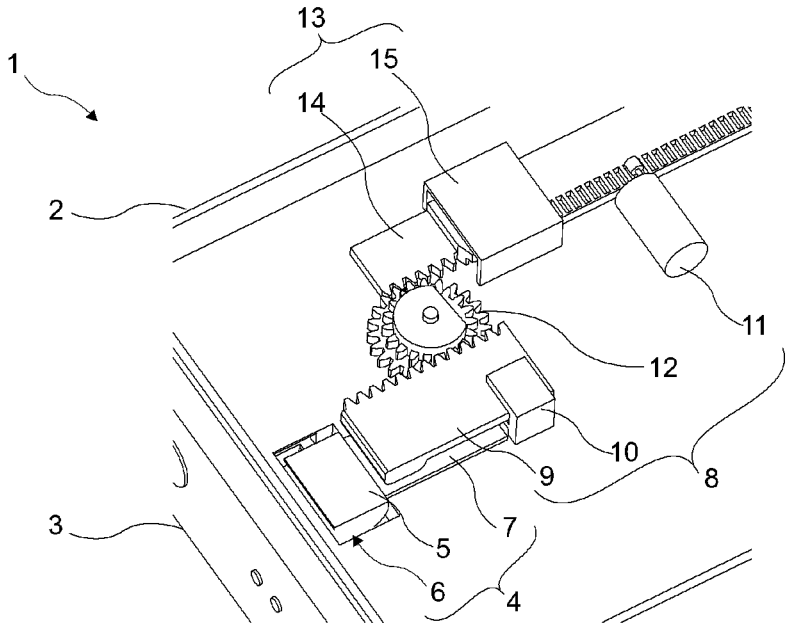

2006/0283482 A1* 12/2006 Berends ..... A47L 15/0034 134/18
2010/0156259 A1* 6/2010 May ..... A47L 15/4257 312/311
2011/0016907 A1* 1/2011 Kang ..... F25D 23/028 62/449
2011/0036383 A1* 2/2011 Tiekoetter ..... A47L 15/4259 134/57 DL
2011/0074261 A1* 3/2011 Assmann ..... A47L 15/4259 312/326
2011/0279004 A1* 11/2011 Assmann ..... A47L 15/4259 312/228

FOREIGN PATENT DOCUMENTS

EP 1733675 A2 12/2006
EP 2130476 A2 12/2009
EP 2193740 A1 6/2010
EP 2210547 A1 7/2010

* cited by examiner

DISHWASHER COMPRISING AN AUTOMATIC DOOR OPENING MECHANISM

The present invention relates to a dishwasher comprising an automatic door opening mechanism.

In dishwashers, after the washing process, the drying process is performed. In some embodiments, at the end of the washing and drying processes, the door of the dishwasher can be partially opened automatically, the hot vapor inside is discharged to the outside and the washed items are provided to dry faster. In dishwashers wherein the door is partially opened automatically at the end of the washing and drying processes, applying less heat in the drying process is sufficient and thus, energy is saved. Opening the dishwasher door automatically, furthermore, prevents the vapor getting cold from condensing and leaving stains on the washed items. In the state of the art, in order that the door is opened automatically, door opening mechanisms are used which extend from the body towards the door and provide the door to be partially opened by pushing the door by the activation of the devices such as solenoid motor or electric motor. The said mechanisms must overcome the resistance of the bolt with the force they apply.

In the state of the art European Patent No EP1733675 and European Patent Applications No EP0687439 and EP0711528, dishwashers are explained, the doors of which are opened automatically at the end of the washing program.

The aim of the present invention is the realization of a dishwasher comprising a door opening mechanism that partially opens the dishwasher door automatically at the end of the washing program.

In the dishwasher realized in order to attain the aim of the present invention, explicated in the first claim and the respective claims thereof, the door is provided to be partially opened by means of the door opening mechanism at the end of the washing and drying processes so that a gap remains between the door and the body. When the door opening mechanism is operated, the pressure applied by the stress means onto the bolt of the locking mechanism of the door and the stiffness level of the stress means are changed simultaneously in order to facilitate the door opening process. An adjustment means simultaneously moves the door opening mechanism and loosens the locking mechanism.

In an embodiment of the present invention, the adjustment means comprises an actuator and a rod that are moved inside a bearing by being actuated by an actuator and wherein the force exerted by the rod on the stress means can be changed.

In another embodiment of the present invention, the door opening mechanism comprises a pusher that applies pressure on the door during opening the door ajar and a guide wherein the pusher is borne.

In another embodiment of the present invention, the adjustment means comprises a transmitter that provides transmission of movement between the rod, the pusher and the actuator.

In a derivative of this embodiment, the actuator actuates the rod, the rod actuates the transmitter and the transmitter actuates the pusher.

In another derivative of this embodiment, the actuator actuates the pusher, the pusher actuates the transmitter and the transmitter actuates the rod.

In another derivative of this embodiment, the actuator actuates the transmitter and the transmitter simultaneously actuates both the rod and the pusher.

In another derivative of this embodiment, on the rod, the pusher and the transmitter there are gear forms and gear canals that provide transmission of movement therebetween.

In another derivative of this embodiment, the gear canal on the pusher is long enough to provide the movement transmitted to the pusher by the actuator, to be partially transmitted to the rod.

In another derivative of this embodiment, the rod and the pusher move simultaneously, but cover different distances.

In the dishwasher of the present invention, the door is slightly opened automatically by means of the door opening mechanism at the end of the washing and drying processes and a fast drying is performed by discharging the vapor accumulated inside the body at the end of the washing and drying processes to the outside. The force to be exerted by the door opening mechanism in order to open the door ajar is decreased by simultaneously decreasing the stiffness level of the stress means connected to the bolt.

The dishwasher realized in order to attain the aim of the present invention is illustrated in the attached figures, where:

FIG. 1—is the schematic isometric view of a dishwasher when the door is in the closed position.

Figure 2:
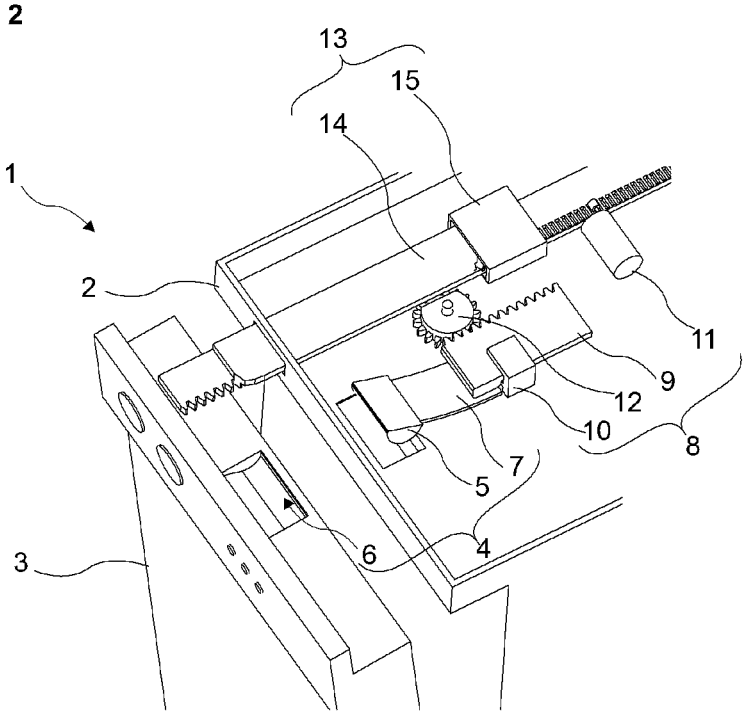

FIG. 2—is the schematic isometric view of a dishwasher when the door is in the open position.

The elements illustrated in the figures are numbered as follows:

1. Dishwasher
2. Body
3. Door
4. Locking mechanism
5. Bolt
6. Housing
7. Stress means
8. Adjustment means
9. Rod
10. Bearing
11. Actuator
12. Transmitter
13. Door opening mechanism
14. Pusher
15. Guide The dishwasher (1) comprises a body (2), a door (3) which provides access into the body (2) and opens from the top downwards by rotating around a horizontal axis, a locking mechanism (4) which provides the locking of the door (3), and a door opening mechanism (13) which provides the door (3) to be partially opened by being pushed at the end of the washing and drying processes so that a gap remains between the door (3) and the body (2).

The locking mechanism (4) comprises a bolt (5), a housing (6) wherein the bolt (5) is seated when the door (3) is in the closed position and a stress means (7) that is connected to the bolt (5).

In the dishwasher (1), the process that starts with loading the items to be washed into the dishwasher (1) before the washing process is started, that includes the washing process and that is completed with the unloading of the washed items from the dishwasher (1) after the washing process is named as a washing cycle.

The dishwasher (1) comprises an adjustment means (8) that simultaneously changes the stiffness level of the stress means (7) and actuates the door opening mechanism (13) at the end of the washing cycle. By means of the adjustment means (8), while the force exerted on the stress means (7) during the rinsing step at the end of the washing cycle is decreased, hence the bolt (5) dislodging from the housing (6) is facilitated, the door opening mechanism (13) is simultaneously actuated. The adjustment means (8) actuates the door opening mechanism (13) and thus provides the automatic opening of the door (3). When the door opening mechanism (13) applies pressure on the door (3), the stiffness level of the stress means (7) is decreased during the steps when the locking mechanism (4) is desired to be opened easily. Thus, the door (3) is provided to be opened easily.

In a derivative of this embodiment, the adjustment means (8) comprises a rod (9) that exerts force on the stress means (7), a bearing (10) where the rod (9) is positioned for moving therein and an actuator (11) that changes the position of the rod (9) and the door opening mechanism (13). The point whereon pressure is exerted on the stress means (7) with the linear movement of the rod (9) that is moved by the actuator (11) changes and respectively the stiffness level of the stress means (7) changes.

In a derivative of this embodiment, the door opening mechanism (13) comprises a pusher (14) that provides the door (3) to be opened ajar by exerting force thereon and a guide (15) wherein the pusher (14) is borne. The pusher (14) is actuated by the actuator (11).

In a derivative of this embodiment, the rod (9) and the pusher (14) are actuated by the actuator (11) in different directions. While the door (3) is being opened ajar, the pusher (14) moves toward the door (3) and the rod (9) moves away from the door (3). While the door (3) is returned to the position wherein it can be closed, the pusher (14) moves away from the door (3) and the rod (9) moves toward the door (3).

In a derivative of this embodiment, the adjustment means (8) comprises a transmitter (12) that provides transmission of movement between the actuator (11), the rod (9) and the pusher (14). The actuator (11) can be an electric motor or a thermal pusher.

In a derivative of this embodiment, the rod (9) is actuated by the actuator (11). In this embodiment, the pusher (14) is actuated by the transmitter (12) that is actuated by the rod (9).

In another derivative of this embodiment, the pusher (14) is actuated by the actuator (11). In this embodiment, the rod (9) is actuated by the transmitter (12) that is actuated by the pusher (14).

In another derivative of this embodiment, the transmitter (12) is actuated by the actuator (11). In this embodiment, both the rod (9) and the pusher (14) are actuated by the transmitter (12).

In a derivative of this embodiment, the transmitter (12) is in form of a gear. In this embodiment, gear canals that are connected in a functional manner with the transmitter (12) in gear form are arranged on the rod (9) and the pusher (14).

In a derivative of this embodiment, the transmitter (12) is composed of gears in different sizes. In this embodiment, gear canals that are connected in a functional manner with the transmitter (12) in gear form are arranged on the rod (9) and the pusher (14). The gear canals on the rod (9) and the pusher (14) have different dimensions from each other. Accordingly, the rod (9) and the pusher (14) are provided to cover different amount of distances during the door (3) being opened ajar. Thus, inconveniences are eliminated, that arise from the movement distance required for decreasing the stiffness level of the stress means (7) being smaller than the distance that pusher (14) must cover for the door (3) to be opened ajar.

In another derivative of this embodiment, the gear canal on the pusher (14) is long enough to provide the movement transmitted to the pusher (14) by the actuator (11), to be partially transmitted to the rod (9). Thus, while the pusher (14) covers the distance required for the door (3) to be opened, the movement of the rod (9) is limited. When the gear form on the transmitter (12) matches the gear canal on the pusher (14), the rod (9) also moves, if not, although the pusher (14) moves, its movement cannot be transmitted to the transmitter (12), thus to the rod (9). After the door (3) is opened ajar, while the door (3) is pushed by the user for closing, the transmitter (12) and the rod (9) move in the reverse direction as a result of the reverse movement of the pusher (14) and the bolt (5) is seated into the housing (6) due to the increase in the force exerted by the rod (9) onto the stress means (7).

In the dishwasher (1) of the present invention, the door (3) is opened automatically by means of the door opening mechanism (13) at the end of the washing and drying processes and a fast drying is performed by discharging the vapor accumulated in the body (2) at the end of the washing and drying processes to the outside. By means of the adjustment means (8), the door opening mechanism (13) applies pressure on the door (3) after being actuated and the opening force of the bolt (5) of the locking mechanism (4) is decreased at the same time. Thus, the door (3) is more easily opened ajar at the end of the rinsing operation.

It is to be understood that the present invention is not limited by the embodiments disclosed above and a person skilled in the art can easily introduce different embodiments. These should be considered within the scope of the protection postulated by the claims of the present invention.

The invention claimed is:

1. A dishwasher (1) comprising a body (2), a door (3) providing access into the body (2) and which opens from the top downwards by rotating around a horizontal axis, and a locking mechanism (4) providing the locking of the door (3), having a bolt (5), a housing (6) wherein the bolt (5) is seated when the door (3) is in the closed position and a stress means (7) that is connected to the bolt (5) and a door opening mechanism (13) which provides the door (3) to be partially opened by being pushed at the end of the washing and drying processes so that a gap remains between the door (3) and the body (2), characterized by an adjustment means (8) that simultaneously changes the stiffness level of the stress means (7) and actuates the door opening mechanism (13) at the end of the washing cycle wherein the adjustment means (8) further comprises a rod (9) that exerts force on the stress means (7), a bearing (10) where the rod (9) is positioned for moving therein and an actuator (11) that changes the position of the rod (9) and the door opening mechanism (13) and wherein the door opening mechanism (13) further comprises a pusher (14) that provides the door (3) to be opened ajar by exerting force on the door (3) and a guide (15) wherein the pusher (14) is borne and wherein the rod (9) and the pusher (14) are simultaneously actuated in different directions by the actuator (11).

2. A dishwasher (1) as in claim 1, characterized by a transmitter (12) that provides transmission of movement between the actuator (11), the rod (9) and the pusher (14).

3. A dishwasher (1) as in claim 2, characterized by the rod (9) actuated by the actuator (11) and the pusher (14) actuated by the transmitter (12) that is actuated by the rod (9).

4. A dishwasher (1) as in claim 2, characterized by the pusher (14) actuated by the actuator (11) and the rod (9) actuated by the transmitter (12) that is actuated by the pusher (14).

5. A dishwasher (1) as in claim 2, characterized by the transmitter (12) that is actuated by the actuator (11) and that actuates both the rod (9) and the pusher (14).

6. A dishwasher (1) as in claim 5, characterized by the transmitter (12) in form of a gear and by the rod (9) and the pusher (14) whereon there are gear canals connected to the transmitter (12) in a functional manner.

7. A dishwasher (1) as in claim 6, characterized by the pusher (14), of which the gear canal thereon is long enough to provide the movement transmitted to the pusher (14) by the actuator (11) to be partially transmitted to the rod (9).

8. A dishwasher (1) as in claim 7, characterized by the rod (9) and the pusher (14) that cover different amount of distances while the door (3) is being opened ajar.

9. A dishwasher (1) comprising a body (2), a door (3) providing access into the body (2) and which opens from the top downwards by rotating around a horizontal axis, and a locking mechanism (4) providing the locking of the door (3), having a bolt (5), a housing (6) wherein the bolt (5) is seated when the door (3) is in the closed position and a stress means (7) that is connected to the bolt (5) and a door opening mechanism (13) which provides the door (3) to be partially opened by being pushed at the end of the washing and drying processes so that a gap remains between the door (3) and the body (2), characterized by an adjustment means (8) that simultaneously changes the stiffness level of the stress means (7) and actuates the door opening mechanism (13) at the end of the washing cycle wherein the adjustment means (8) further comprises a rod (9) that exerts force on the stress means (7), a bearing (10) where the rod (9) is positioned for moving therein and an actuator (11) that changes the position of the rod (9) and the door opening mechanism (13) and wherein the door opening mechanism (13) further comprises a pusher (14) that provides the door (3) to be opened ajar by exerting force on the door (3) and a guide (15) wherein the pusher (14) is borne and wherein and a transmitter (12) that provides transmission of movement between the actuator (11), the rod (9) and the pusher (14).

10. A dishwasher (1) as in claim 9, characterized by the rod (9) actuated by the actuator (11) and the pusher (14) actuated by the transmitter (12) that is actuated by the rod (9).

11. A dishwasher (1) as in claim 9, characterized by the pusher (14) actuated by the actuator (11) and the rod (9) actuated by the transmitter (12) that is actuated by the pusher (14).

12. A dishwasher (1) as in claim 9, characterized by the transmitter (12) that is actuated by the actuator (11) and that actuates both the rod (9) and the pusher (14).

13. A dishwasher (1) as in claim 9, characterized by the transmitter (12) in form of a gear and by the rod (9) and the pusher (14) whereon there are gear canals connected to the transmitter (12) in a functional manner.

14. A dishwasher (1) as in claim 13, characterized by the pusher (14), of which the gear canal thereon is long enough to provide the movement transmitted to the pusher (14) by the actuator (11) to be partially transmitted to the rod (9).

15. A dishwasher (1) as in claim 9, characterized by the rod (9) and the pusher (14) that cover different amount of distances while the door (3) is being opened ajar.

* * * * *